US007712305B2

(12) United States Patent
Kapsos et al.

(10) Patent No.: US 7,712,305 B2
(45) Date of Patent: May 11, 2010

(54) EXHAUST AFTERTREATMENT SYSTEM WITH SPIRAL MIXER

(75) Inventors: David W. Kapsos, McFarland, WI (US); Cary D. Bremigan, Madison, WI (US); Mark P. Adams, Madison, WI (US); Patrick M. Klein, Madison, WI (US)

(73) Assignee: Universal Silencer, LLC, Stoughton, WI (US)

( * ) Notice: Subject to any disclaimer, the term of this patent is extended or adjusted under 35 U.S.C. 154(b) by 48 days.

(21) Appl. No.: 11/508,652

(22) Filed: Aug. 23, 2006

(65) Prior Publication Data

US 2008/0047260 A1 Feb. 28, 2008

(51) Int. Cl.
*F01N 3/00* (2006.01)

(52) U.S. Cl. ..... 60/286; 60/282; 60/295; 60/297; 60/303; 60/324

(58) Field of Classification Search ..... 60/272, 60/280, 283, 286, 295, 303, 307, 315, 324, 60/297

See application file for complete search history.

(56) References Cited

U.S. PATENT DOCUMENTS 3,208,441 A * 9/1965 Ottofy ..... 123/552
3,273,161 A * 9/1966 Di Giorgio ..... 123/557
3,577,728 A * 5/1971 Von Brimer et al. ..... 60/283
4,318,386 A * 3/1982 Showalter et al. ..... 123/590
4,580,544 A * 4/1986 Walker ..... 123/590
4,872,528 A 10/1989 Goplen et al.
5,941,069 A * 8/1999 Heath ..... 60/307
6,361,754 B1 * 3/2002 Peter-Hoblyn et al. ... 423/213.2
6,449,947 B1 9/2002 Liu et al.
6,540,046 B1 4/2003 Schuhmacher et al.
6,601,385 B2 8/2003 Verdegan et al.
6,712,869 B2 3/2004 Cheng et al.
6,722,123 B2 4/2004 Liu et al.
6,796,296 B2 9/2004 Kim
2005/0257530 A1 11/2005 Zupanc et al.

FOREIGN PATENT DOCUMENTS

JP 2003232218 8/2003

* cited by examiner

*Primary Examiner*—Binh Q. Tran
(74) *Attorney, Agent, or Firm*—Andrus, Sceales, Starke & Sawall, LLP

(57) ABSTRACT

An exhaust aftertreatment system, including injection of chemical species, includes a mixer provided by a spiral chamber.

19 Claims, 2 Drawing Sheets

EXHAUST AFTERTREATMENT SYSTEM WITH SPIRAL MIXER

BACKGROUND AND SUMMARY

The invention relates to aftertreatment systems for internal combustion engine exhaust, and more particularly to chemical species injection mixing.

To address engine emission concerns, new standards continue to be proposed for substantial reduction of various emissions, including NOx and particulate emissions. Increasingly stringent standards will require installation of aftertreatment devices in engine exhaust systems. Some of the aftertreatment technologies require certain chemical species to be injected into the exhaust system. For example, HC or fuel is injected in some active lean NOx systems for NOx reduction, or in active diesel particulate filters (DPF) for regeneration to take place (oxidizing the soot and cleaning the filter), and urea solution is injected in selective catalytic reduction (SCR) systems for NOx reduction. These injected chemical species need to be well mixed with exhaust gas before reaching catalysts or filters for the systems to perform properly.

The present invention arose during continuing development efforts directed toward the above exhaust aftertreatment systems. In one aspect, a compact mixer is provided. In a system with exhaust flow along an axial direction, a longer mixing distance/time is enabled without increasing axial length.

DETAILED DESCRIPTION

Figure 2:
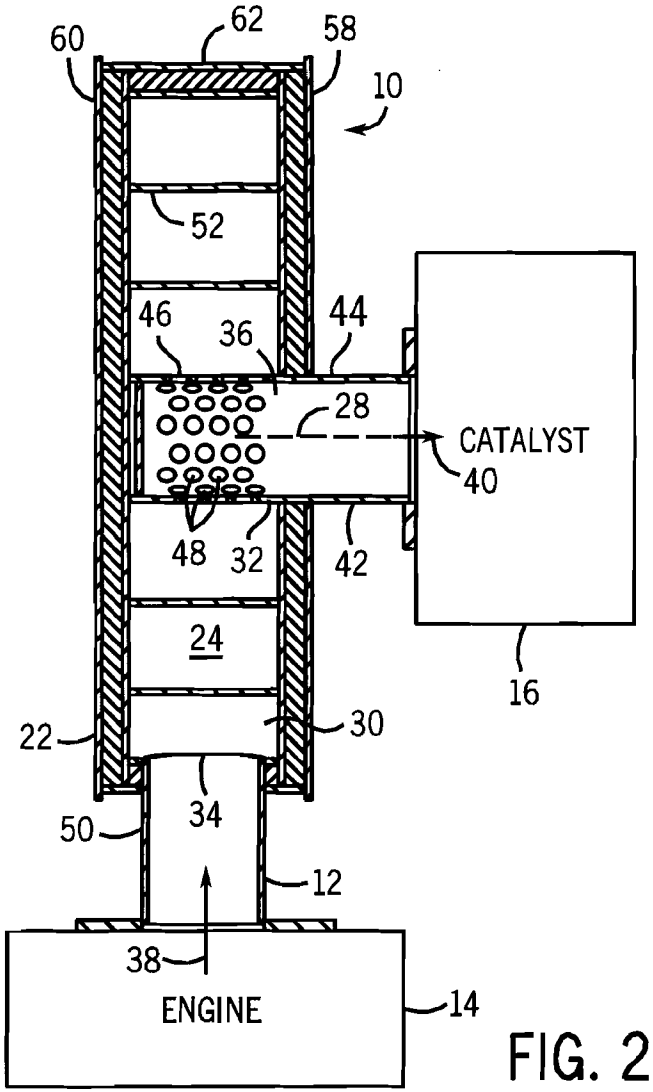
FIG. 2 is a sectional view taken along line 2-2 of FIG. 1.
Figure 1:
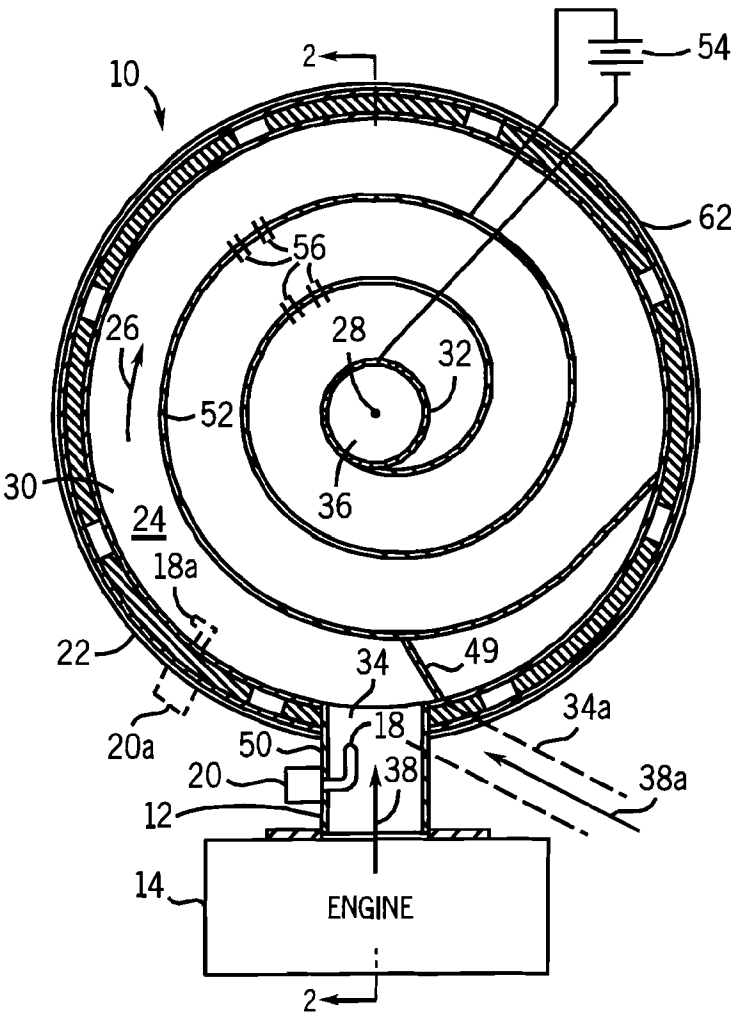
FIG. 1 is a schematic sectional view of an exhaust aftertreatment system in accordance with the invention.

FIGS. 1 and 2 show an exhaust aftertreatment system 10 including an exhaust conduit 12 carrying internal combustion engine exhaust from engine 14 to an aftertreatment element 16, FIG. 2, treating the exhaust, for example a selective catalytic reduction (SCR) catalyst and/or an oxidation catalyst (e.g. a diesel oxidation catalyst, DOC). An injector 18 is provided upstream of aftertreatment element 16 and injects chemical species mixing with the exhaust prior to reaching aftertreatment element 16. For example, in one embodiment, aqueous urea solution is injected from reservoir or tank 20. A mixer 22 is provided in the exhaust system upstream of aftertreatment element 16 and mixing the chemical species and the exhaust. The injected chemical species needs to be well-mixed with the exhaust gas prior to reaching aftertreatment element 16 to ensure optimal performance for chemical reaction. Mixer 22 is a spiral chamber 24.

Spiral chamber 24 has a spiral exhaust flow passage 26 around a central axis 28. The spiral exhaust flow passage has an outer reach 30 spaced radially outwardly of central axis 28, and has an inner reach 32 spaced radially inwardly of outer reach 30. Spiral chamber 24 has first and second exhaust flow ports 34 and 36 for exhaust flow therethrough. In the disclosed embodiment, exhaust flow port 34 is an inlet exhaust flow port receiving exhaust from engine 14 as shown at arrow 38, and exhaust flow port 36 is an outlet exhaust flow port discharging exhaust to aftertreatment element or catalyst 16 as shown at arrow 40. Inner reach 32 provides the center of the spiral at central axis 28. Exhaust flow port 34 is at outer reach 30. Exhaust flow port 36 is at inner reach 32. Exhaust flows from inner reach 32 of the spiral through outlet exhaust flow port 36 along an axial flow direction 40 along central axis 28. In the embodiment of FIGS. 1, 2, an outlet exhaust pipe 42 extends axially from spiral chamber 24 at outlet exhaust flow port 36. Outlet exhaust pipe 42 has an outer portion 44 extending axially externally of spiral chamber 24 and conducting exhaust axially therethrough for transmission to aftertreatment element 16. Outlet exhaust pipe 42 has an inner portion 46 extending axially internally of spiral chamber 24. Inner portion 46 of outlet exhaust pipe 42 is perforated as shown at 48 and receives exhaust through such perforations from spiral chamber 24 at inner reach 32 thereof.

Exhaust flows through exhaust flow port 34 along a first flow direction as shown at arrow 38. Exhaust flows through exhaust flow port 36 along a second flow direction as shown at arrow 40. Flow directions 38 and 40 are non-parallel to each other. Exhaust flows through exhaust flow port 36 along an axial flow direction 40. Exhaust flows through exhaust flow port 34 along a lateral flow direction 38 along a lateral plane transverse to axis 28. Spiral exhaust passage 26 guides exhaust flow along a spiral pattern lying in the noted lateral plane. Exhaust flows through exhaust flow port 34 along the noted flow direction 38 radially relative to axis 28. An angled guidance wall 49 may optionally be provided at the spiral entrance adjacent port 34. In another embodiment, exhaust flow port 34 is instead oriented as shown in dashed line at 34*a* such that exhaust flows through exhaust flow port 34*a* along flow direction 38*a* tangentially relative to the noted spiral of spiral exhaust passage 26, for reduced pressure drop.

In the embodiment of FIGS. 1, 2, an inlet exhaust pipe 50 extends from spiral chamber 24 at inlet exhaust flow port 34, and injector 18 is in inlet exhaust pipe 50 and injects chemical species into the exhaust prior to and upstream of spiral chamber 24. In an alternate embodiment, injector 18*a* is in spiral chamber 24 and injects the chemical species from tank 20*a* into exhaust flowing in spiral chamber 24.

Spiral chamber 24 has an inner scroll wall 52 defining spiral exhaust flow passage 26. Scroll wall 52 may optionally be heated by a heater, e.g. by electrical resistance heating from a voltage source such as a battery 54, heating the scroll wall to enhance interaction of the chemical species and the exhaust, and to assist evaporation and hydrolysis. In another embodiment, scroll wall 52 may be perforated, for example as shown at 56, for improved acoustic performance. Spiral chamber 24 has first and second axially spaced chamber end walls 58 and 60, FIG. 2, and has an outer circumferential housing wall 62 extending axially therebetween. Inner scroll wall 52 is disposed axially between chamber end walls 58 and 60.

Figure 4:
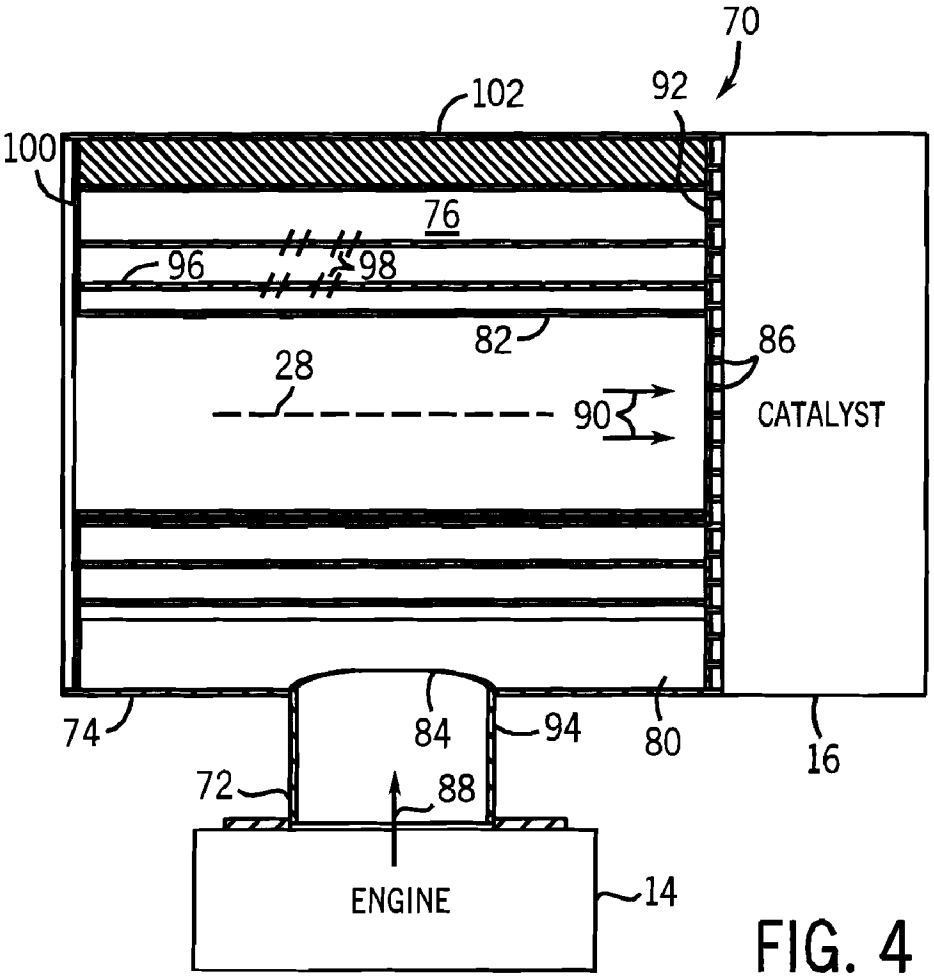
FIG. 4 is a sectional view taken along line 4-4 of FIG. 3.
Figure 3:
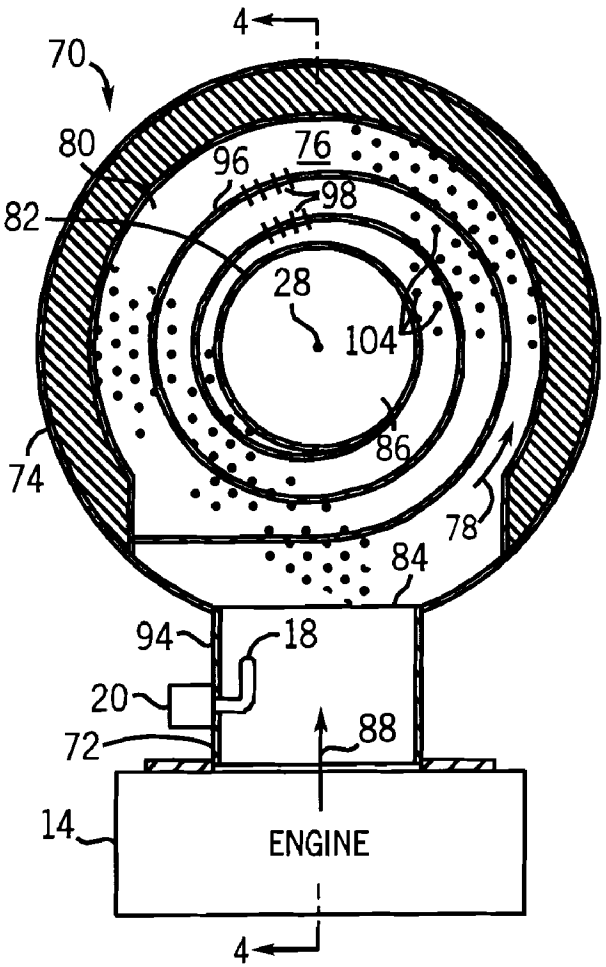
FIG. 3 is like FIG. 1 and shows another embodiment.

FIGS. 3, 4 show another embodiment and use like reference numerals from above where appropriate to facilitate understanding. Exhaust aftertreatment system 70 includes exhaust conduit 72 carrying exhaust from engine 14 to aftertreatment element 16, FIG. 4, treating the exhaust. Injector 18 injects chemical species from tank 20 mixing with the exhaust prior to reaching aftertreatment element 16. A mixer 74 mixes the chemical species and the exhaust. Mixer 74 is a spiral chamber 76 having a spiral exhaust flow passage 78 around central axis 28. Spiral exhaust flow passage 78 has an outer reach 80 spaced radially outwardly of central axis 28, and has an inner reach 82 spaced radially inwardly of outer reach 80. Spiral chamber 76 has first and second exhaust flow ports 84 and 86 for exhaust flow therethrough. In the embodiment of FIGS. 3, 4, exhaust flow port 84 is an inlet exhaust flow port receiving exhaust from engine 14 as shown at arrow 88. Exhaust flow port 86 is an outlet exhaust flow port, and exhaust flows from spiral chamber 76 through outlet exhaust flow port 86 along an axial flow direction 90. Inner reach 82 provides the center of the spiral at central axis 28. Exhaust flow port 84 is at outer reach 80. Exhaust flow port 86 is at inner reach 82 and also along the downstream chamber end wall 92 spanning between inner reach 82 and outer reach 80, to be described. In the embodiment of FIGS. 3, 4, outlet exhaust pipe 42 of FIG. 2 is eliminated, and instead chamber wall 92 is perforated and provides exhaust flow therethrough to aftertreatment element 16.

In FIGS. 3, 4, exhaust flows through exhaust flow port 84 along flow direction 88, and exhaust flows through exhaust flow port 86 along flow direction 90. First and second flow directions 88 and 90 are non-parallel to each other. Exhaust flows through exhaust flow port 86 along axial flow direction 90. Exhaust flows through exhaust flow port 84 along a lateral flow direction 88 along a lateral plane transverse to axis 28. Spiral exhaust passage 78 guides exhaust flow along a spiral pattern lying in the noted lateral plane. Exhaust flows through exhaust flow port 84 along the noted flow direction 88 radially relative to axis 28. In an alternate embodiment, exhaust flow port 84 may instead by oriented like that shown in dashed line at 34*a* in FIG. 1 such that exhaust flows through the exhaust flow port in a flow direction tangentially relative to the spiral. Injector 18 may be provided in an inlet exhaust pipe 94 extending from the spiral chamber at inlet exhaust flow port 84, such that injector 18 is in inlet exhaust pipe 94 and injects chemical species into the exhaust prior to and upstream of spiral chamber 76. Alternatively, the injector may be provided in spiral chamber 76, for example as shown in dashed line at 18*a* in FIG. 1, such that the injector injects the chemical species into the exhaust flowing in spiral chamber 76.

Spiral chamber 76 in FIGS. 3, 4 has an inner scroll wall 96 defining spiral exhaust flow passage 78. A heater, such as heater 54 in FIG. 1, may be provided for heating scroll wall 96 to enhance interaction of the chemical species and the exhaust, e.g. by assisting evaporation and hydrolysis of urea. Scroll wall 96 may be perforated, for example as shown at 98, to gain additional acoustic performance. Spiral chamber 76 has the noted first and second exhaust flow ports 84, 86 for exhaust flow therethrough. Spiral chamber 76 has first and second axially spaced chamber end walls 100 and 92 and an outer circumferential housing wall 102 spanning axially therebetween. Inner scroll wall 96 is disposed axially between chamber end walls 100 and 92. Chamber wall 92 is perforated at 104 and provides the noted exhaust flow port 86 for exhaust flow therethrough as shown at arrows 90. This provides improved flow distribution prior to entering aftertreatment catalyst section 16, to assist optimization of catalyst performance. The perforations 104 of chamber end wall 92 span at least partially between the noted inner and outer reaches 82 and 80 of spiral exhaust flow passage 78, and provide the noted exhaust flow port 86. In the embodiment of FIGS. 3, 4, exhaust flow port 86 is an outlet exhaust flow port supplying exhaust to aftertreatment element 16, and perforations 104 of chamber end wall 92 distribute flow from outlet exhaust port 86 to aftertreatment element 16.

In the foregoing description, certain terms have been used for brevity, clearness, and understanding. No unnecessary limitations are to be implied therefrom beyond the requirement of the prior art because such terms are used for descriptive purposes and are intended to be broadly construed. The different configurations, methods and systems described herein may be used alone or in combination with other configurations, methods, and systems. It is to be expected that various equivalents, alternatives and modifications are possible within the scope of the appended claims.

What is claimed is:

1. An exhaust aftertreatment system comprising an exhaust conduit carrying exhaust to an aftertreatment element treating said exhaust, an injector injecting chemical species mixing with said exhaust prior to reaching said aftertreatment element, a mixer in said exhaust system upstream of said aftertreatment element and mixing said chemical species and said exhaust, wherein said mixer is a spiral chamber configured to facilitate long mixing distance and time without increasing axial length and thus providing a compact mixer arrangement;

wherein said spiral chamber has an inner scroll wall defining a spiral exhaust flow passage, and comprising a heater heating said scroll wall to enhance interaction of said chemical species and said exhaust.

2. The exhaust aftertreatment system according to claim 1 wherein said spiral chamber has a spiral exhaust flow passage around a central axis, said spiral exhaust flow passage having an outer reach spaced radially outwardly of said central axis, and having an inner reach spaced radially inwardly of said outer reach, said spiral chamber having first and second exhaust flow ports for exhaust flow therethrough.

3. The exhaust aftertreatment system according to claim 2 wherein said first exhaust flow port is an inlet exhaust flow port, and said second exhaust flow port is an outlet exhaust flow port, and wherein exhaust flows from said spiral chamber through said outlet exhaust flow port along an axial flow direction.

4. The exhaust aftertreatment system according to claim 2 wherein said inner reach provides the center of the spiral at said central axis, said first exhaust flow port is at said outer reach, and said second exhaust flow port is at said inner reach.

5. The exhaust aftertreatment system according to claim 4 wherein said first exhaust flow port is an inlet exhaust flow port, and said second exhaust flow port is an outlet exhaust flow port, and wherein exhaust flows from said inner reach of said spiral through said outlet exhaust flow port along an axial flow direction along said central axis.

6. The exhaust aftertreatment system according to claim 2 wherein exhaust flows through said first exhaust flow port along a first flow direction, and exhaust flows through said second exhaust flow port along a second flow direction, wherein said first and second flow directions are non-parallel to each other.

7. The exhaust aftertreatment system according to claim 6 wherein exhaust flows through said second exhaust flow port along an axial said second flow direction, and exhaust flows through said first exhaust flow port along a lateral said first flow direction along a lateral plane transverse to said axis.

8. The exhaust aftertreatment system according to claim 7 wherein said spiral exhaust passage guides exhaust flow along a spiral pattern lying in said lateral plane.

9. The exhaust aftertreatment system according to claim 7 wherein exhaust flows through said first exhaust flow port along said first flow direction radially relative to said axis.

10. The exhaust aftertreatment system according to claim 7 wherein exhaust flows through said first exhaust flow port along said first flow direction tangentially relative to said spiral.

11. The exhaust aftertreatment system according to claim 1 wherein said spiral chamber has a spiral exhaust flow passage around a central axis, said spiral exhaust flow passage having an outer reach spaced radially outwardly of said central axis, and having an inner reach providing the center of the spiral at said central axis, said spiral chamber having a first exhaust flow port at said outer reach and a second exhaust flow port at said inner reach, wherein exhaust flows through said second exhaust flow port at said inner reach along an axial flow direction along said central axis, and wherein exhaust flows through said first exhaust flow port at said outer reach along a lateral flow direction along a lateral plane transverse to said axis.

12. The exhaust aftertreatment system according to claim 1 wherein said injector is in said spiral chamber and injects said chemical species into said exhaust flowing in said spiral chamber.

13. The exhaust aftertreatment system according to claim 1 wherein said spiral chamber has an inner scroll wall defining a spiral exhaust flow passage, and wherein said scroll wall is perforated.

14. The exhaust aftertreatment system according to claim 1 wherein said spiral chamber has an inner scroll wall defining a spiral exhaust flow passage, said spiral chamber having first and second exhaust flow ports for exhaust flow therethrough, said spiral chamber having first and second axially spaced chamber walls having said scroll wall disposed axially therebetween.

15. An exhaust aftertreatment system comprising an exhaust conduit carrying exhaust to an aftertreatment element treating said exhaust, an injector injecting chemical species mixing with said exhaust prior to reaching said aftertreatment element, a mixer in said exhaust system upstream of said aftertreatment element and mixing said chemical species and said exhaust, wherein said mixer is a spiral chamber configured to facilitate long mixing distance and time without increasing axial length and thus providing a compact mixer arrangement;

wherein said first exhaust flow port is an inlet exhaust flow port, and said second exhaust flow port is an outlet exhaust flow port, and wherein exhaust flows from said inner reach of said spiral through said outlet exhaust flow port along an axial flow direction along said central axis; and an outlet exhaust pipe extending axially from said spiral chamber at said outlet exhaust flow port, said outlet exhaust pipe having an outer portion extending axially externally of said spiral chamber and conducting exhaust axially therethrough for transmission to said aftertreatment element, said outlet exhaust pipe having an inner portion extending axially internally of said spiral chamber, said inner portion of said outlet exhaust pipe being perforated and receiving exhaust through such perforations from said spiral chamber at said inner reach thereof.

16. An exhaust aftertreatment system comprising an exhaust conduit carrying exhaust to an aftertreatment element treating said exhaust, an injector injecting chemical species mixing with said exhaust prior to reaching said aftertreatment element, a mixer in said exhaust system upstream of said aftertreatment element and mixing said chemical species and said exhaust, wherein said mixer is a spiral chamber configured to facilitate long mixing distance and time without increasing axial length and thus providing a compact mixer arrangement;

wherein said spiral chamber has first and second exhaust flow ports for exhaust flow therethrough, wherein one of said first and second exhaust flow ports is an inlet exhaust flow port, and comprising an inlet exhaust pipe extending from said spiral chamber at said inlet exhaust flow port, and wherein said injector is in said inlet exhaust pipe and injects said chemical species into said exhaust prior to and upstream of said spiral chamber.

17. An exhaust aftertreatment system comprising an exhaust conduit carrying exhaust to an aftertreatment element treating said exhaust, an injector injecting chemical species mixing with said exhaust prior to reaching said aftertreatment element, a mixer in said exhaust system upstream of said aftertreatment element and mixing said chemical species and said exhaust, wherein said mixer is a spiral chamber configured to facilitate long mixing distance and time without increasing axial length and thus providing a compact mixer arrangement;

wherein said spiral chamber has an inner scroll wall defining a spiral exhaust flow passage, said spiral chamber having first and second exhaust flow ports for exhaust flow therethrough, said spiral chamber having first and second axially spaced chamber walls having said scroll wall disposed axially therebetween; and wherein said second chamber wall is perforated and provides said second exhaust flow port for exhaust flow therethrough.

18. The exhaust aftertreatment system according to claim 17 wherein said spiral exhaust flow passage has an outer reach spaced radially outwardly of a central axis, and has an inner reach spaced radially inwardly of said outer reach, said first exhaust flow port is at said outer reach, and the perforations of said second chamber wall span at least partially between said inner and outer reaches and provide said second exhaust flow port.

19. The exhaust aftertreatment system according to claim 18 wherein said second exhaust flow port is an outlet exhaust flow port supplying exhaust to said aftertreatment element, and said perforations of said second chamber wall distribute flow from said outlet exhaust flow port to said aftertreatment element.

* * * * *